United States Patent [19]

Burgess et al.

[11] 3,987,902

[45] Oct. 26, 1976

[54] PACKAGE INSPECTION APPARATUS

[76] Inventors: Billy Burgess, 5770 Hollybrook Lane, Sylvania, Ohio 43560; Washington I. McGilvery, 11175 West St., Whitehouse, Ohio 43571; John R. Michael, 439 N. River Road, Waterville, Ohio 43566; Robert P. Snyder, 5669 Dornell Drive, Sylvania, Ohio 43560; John Henry Burgess, deceased, late of Sylvania, Ohio; by Norma Lou Burgess, administratrix, 5663 Dornell Drive, Sylvania, Ohio 43560

[22] Filed: May 31, 1974

[21] Appl. No.: 474,958

[52] U.S. Cl. ..... 209/75; 209/111.7 T; 250/223 R

[51] Int. Cl.[2] ..... B07C 5/342

[58] Field of Search ..... 209/82, 111.7, 75; 250/223 R, 562, 572

[56] References Cited

UNITED STATES PATENTS

| | | | |
|---|---|---|---|
| 2,916,633 | 12/1959 | Stone | 250/223 R |
| 3,089,594 | 5/1963 | Earley | 209/111.7 |
| 3,096,871 | 7/1963 | Anderson | 250/223 R |
| 3,349,905 | 10/1967 | Crawford | 209/111.7 |
| 3,566,135 | 2/1971 | Mouchant | 209/111.7 |
| 3,603,457 | 9/1971 | Flodin | 209/111.7 |

*Primary Examiner*—Allen N. Knowles
*Attorney, Agent, or Firm*—Paul F. Stutz

[57] ABSTRACT

Package conveyor and inspection apparatus moves reams of paper through a sequence of operations including inspection of the outer wrapper, application of a label, inspection of the label location and inclusive of means for rejecting reams which are either mis-wrapped or mislabeled; the remainder of the properly wrapped and labeled reams being directed for further processing.

8 Claims, 12 Drawing Figures

PACKAGE INSPECTION APPARATUS

The present invention relates to apparatus of utility in conveying, labeling and inspecting reams of paper. Normally, writing paper is packaged or wrapped in an outer paper covering and is then marketed as a ream consisting of a given multiplicity of sheets of the paper. The paper is cut from roll stock into preselected standard sizes, such as 8 × 10, 8-½ × 11, 11, × 13 and/or 11 × 17, combined with like sized sheets of paper, thence wrapped and sealed. Desirably, the individual reams have affixed thereto a label identifying the contents, the manufacturer and other useful information of utility to the handler, supplier and user, such as size, weight, rag content, color, etc. The sheets of paper are combined into the ream and then wrapped by automatic machinery, by reason of which the tightness of the wrap is not always what is should be. If the paper is loosely wrapped, bulges, loose edges, loose flaps and gaps in the various folds result such that the package or ream is easily destroyed and/or tied up in the automatic packaging machinery employed in the further processing of the reams.

It is an object of the present invention to provide an apparatus which is adapted to receive, in sequence, reams of paper, to inspect the reams for good or bad wrap, to apply the label to the ream, to inspect the label and to reject mislabeled or miswrapped reams.

It is a particular object of the present invention to provide such an apparatus which includes electrical control circuitry for providing the sequence of operations as the reams are moved automatically in single file through the plurality of stations designed to accomplish the desired end.

It is likewise an object of the present invention to provide a ream conveyor which includes variable provisions for rapidly, yet sequentially, inspecting the marginal or perimetric girth surfaces of a ream to determine if it falls within certain limits and for rejecting the ream if its perimetric condition reflects it as being improperly wrapped and not within the selected ranges of variability.

It is also an object of the present invention to provide a ream conveying apparatus which includes provisions for automatic inspection of an applied label, including auxiliary and cooperating means for removing a package or ream in which the label is not present or is not properly located on the desired surface of the ream.

It is still another object of the present invention to provide such an apparatus which includes means for applying a label to a ream as it is conveyed linearly along the path of conveyance provided.

It is a significant object of the present invention to provide an apparatus as described which is capable of performing the desired functions of movement, indexing, inspect quality of wrap, miswrapped ream rejection, labeling, label inspection and mislabel rejection in rapid sequence approaching 50 reams per minute output.

The foregoing as well as other objects of the present invention will become apparent to those skilled in the art from the following detailed description taken in conjunction with the annexed sheets of drawings on which there is presented, for purpose of illustration only, a single embodiment of the ream conveying, inspecting and labeling apparatus of the present invention. In the drawings.

Figure 4:
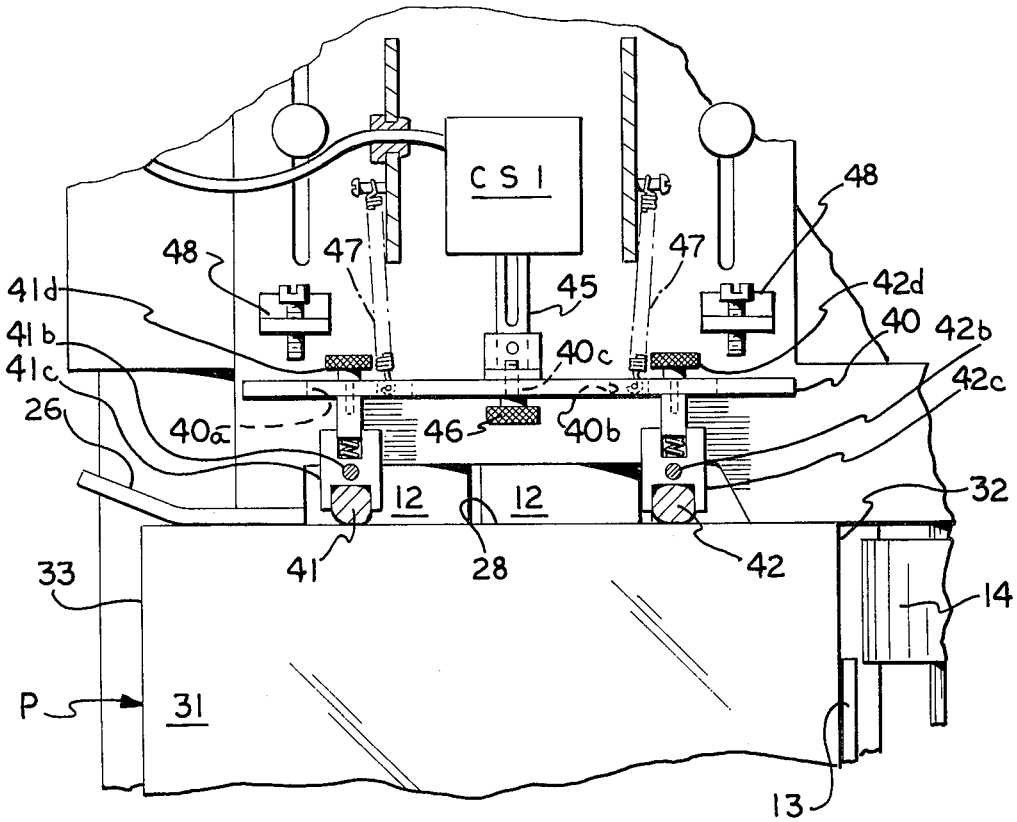
Figure 10:
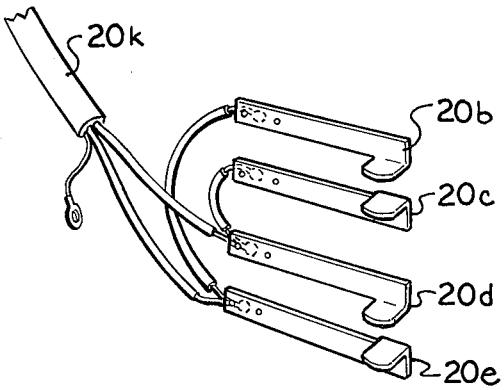
Figure 6:
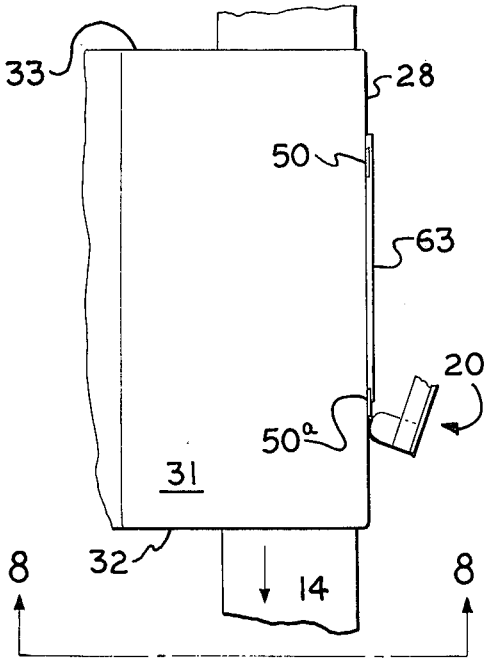
Figure 7:
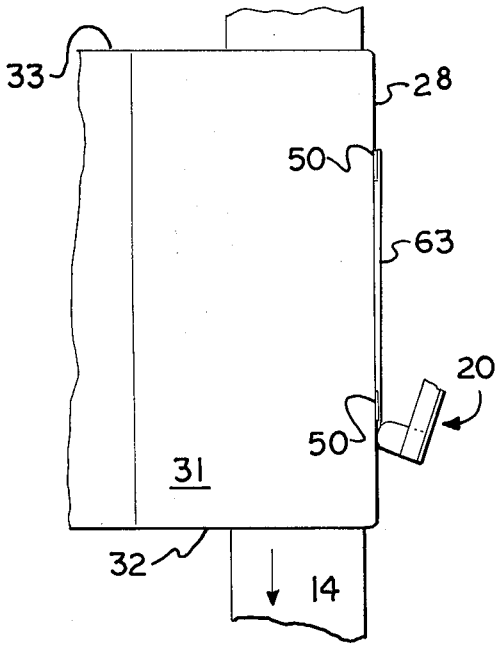
Figure 5:
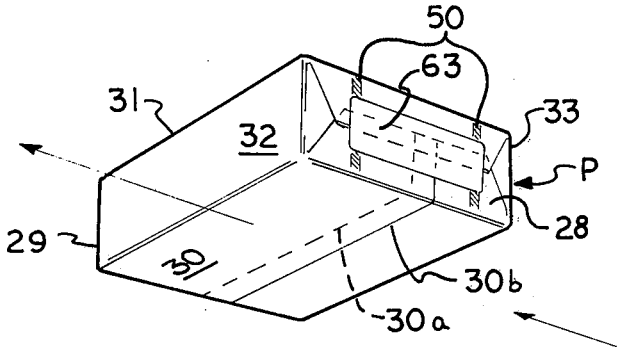
Figure 8:
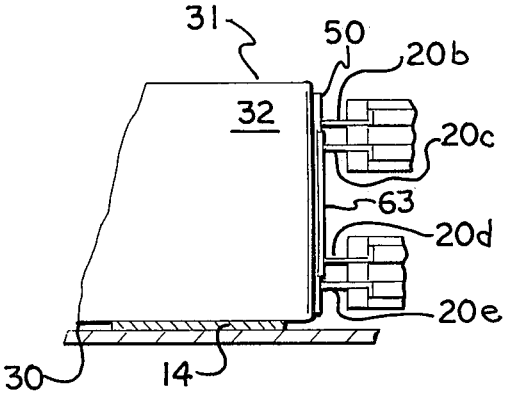
Figure 9:
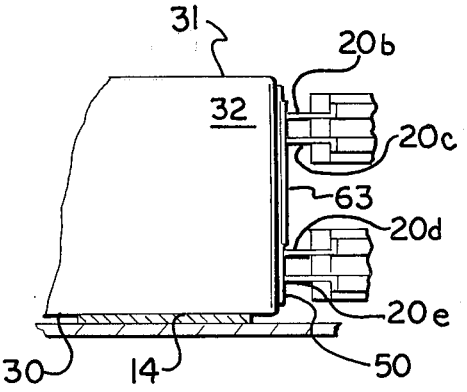
Figure 11:
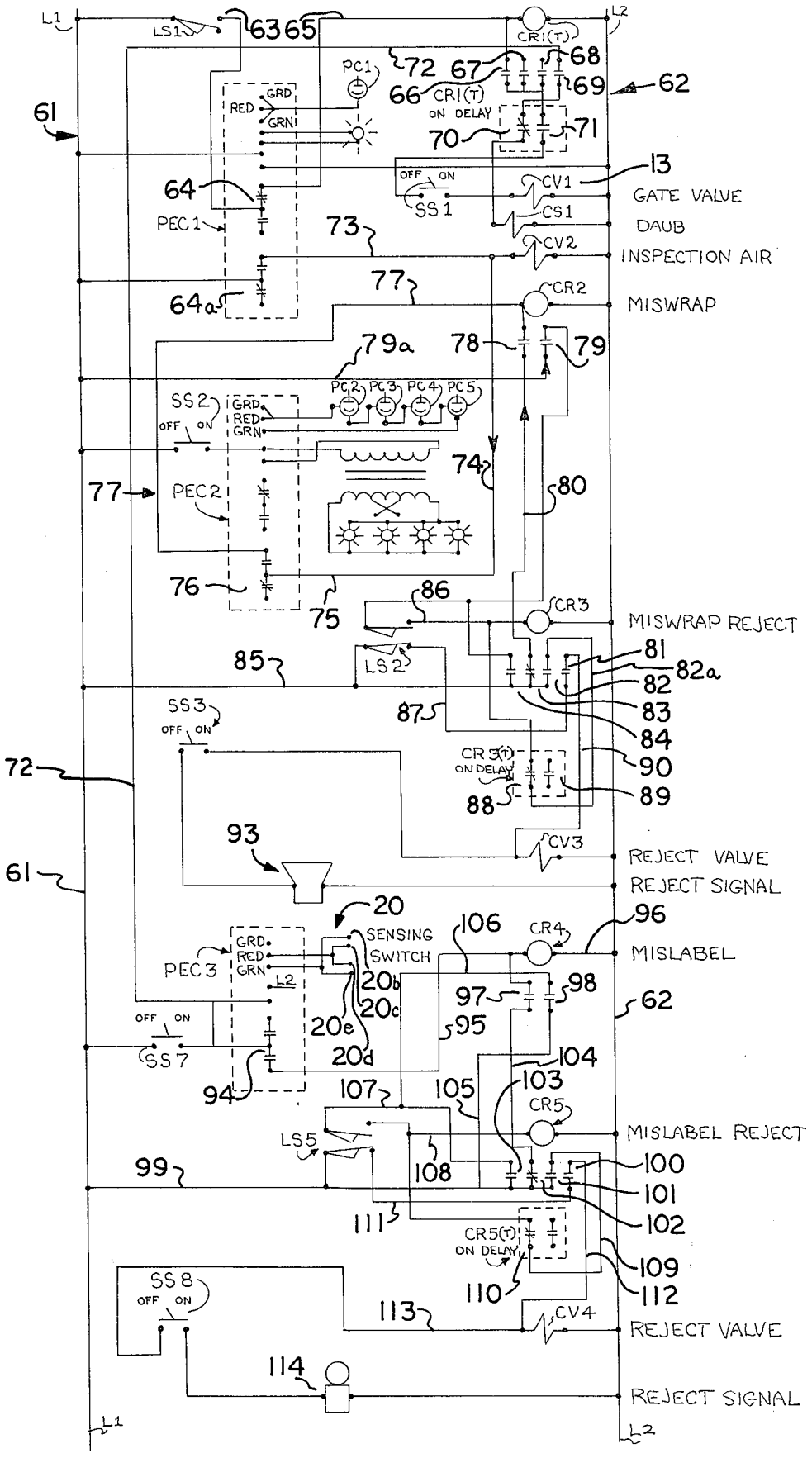
Figure 12:
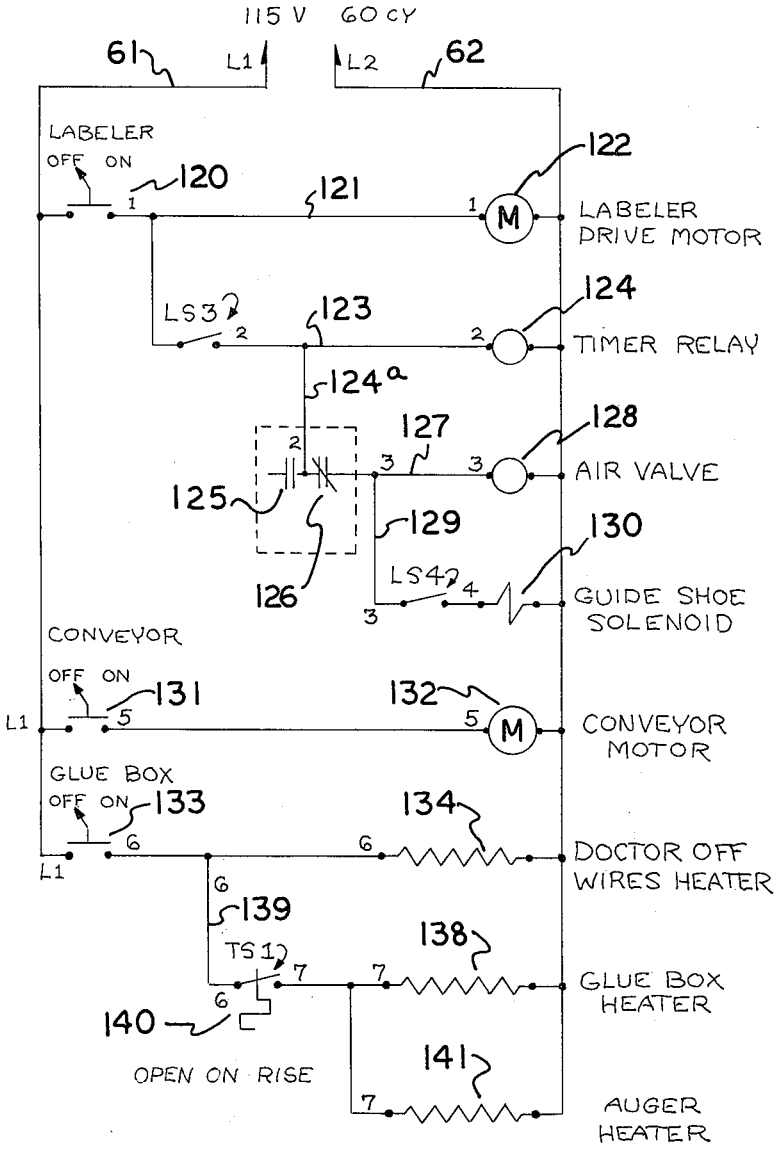

FIG. 4 is a sectional view taken on the line 4—4 of FIG. 2. and particularly of the initial loading station encountered by the reams as they are introduced to the apparatus of the present invention and additionally showing in detail auxiliary apparatus for applying spaced strip depositions of a liquid, electrically-conducting coating employed subsequently in inspecting the proper location of the subsequently applied label to the end of the ream bearing the strips;

FIG. 5 is a perspective view of a typical ream and particularly showing the outer wrap of paper, featuring an overlap seam on the bottom surface, end fold flaps, an applied label and the spaced strip depositions of a liquid, electrically-conducting coating;

FIG. 6 is a schematic top plan view of a ream located on a moving belt with a miscentered label on the flap end, said label being miscentered with respect to the forward and trailing ends of the ream taken with respect to the direction of travel, with the inspection sensor contacting the inspection strips normally covered by a properly centered label;

FIG. 7 is a view similar to FIG. 6 but with the label properly centered such that the label sensors encounter a properly centered label and do not contact the strips;

FIG. 8 is an end view taken on the line 8—8 in FIG. 6 and thus a front elevation view of a ream and schematically illustrating a label properly centered with respect to the top and bottom of the ream with the sensor elements in position to inspect and discern the proper centering;

FIG. 9 is a view similar to FIG. 8, but schematically illustrating the label off center in the direction of the top of the ream and with the sensor elements in position to detect this miscentered label by contact with the uncovered conducting coating;

FIG. 10 is a three-quarter perspective view of the inspecting station sensor including its contact elements and electrical connections;

FIG. 11 is an electrical circuit diagram of the various circuits and electrical elements such as relays, switches, solenoids and photocells which, when physically located in the manner described and connected as illustrated, control the sequential series of operations described hereinafter; and FIG. 12 is an electrical circuit diagram showing variant circuitry employed in the labeling station.

Considered most simply, the apparatus of the present invention operates as follows. Prewrapped and sealed reams are received by the apparatus in sequence, marked with electricity-conducting liquid strips on the end flaps on one side, moved rapidly and sequentially in a linear path where initially the girth or perimeter of the ream is automatically inspected and the ream rejected physically from the path if the wrap is not satisfactory, as evidenced by protruding flaps, wrapper bulges, etc., thence labeled across the end flap, followed by an automatic inspection of the label with automatic rejection of a ream which is mislabeled and finally the properly wrapped and labeled reams delivered in sequence and rapidly to a desired terminus for successive operations.

Reference may now be had to the various figures for an understanding, coupled with the description to follow, of the operation of the apparatus and the optimum mode of carrying out the desired sequence of operations in accordance with the present invention.

Figure 1:
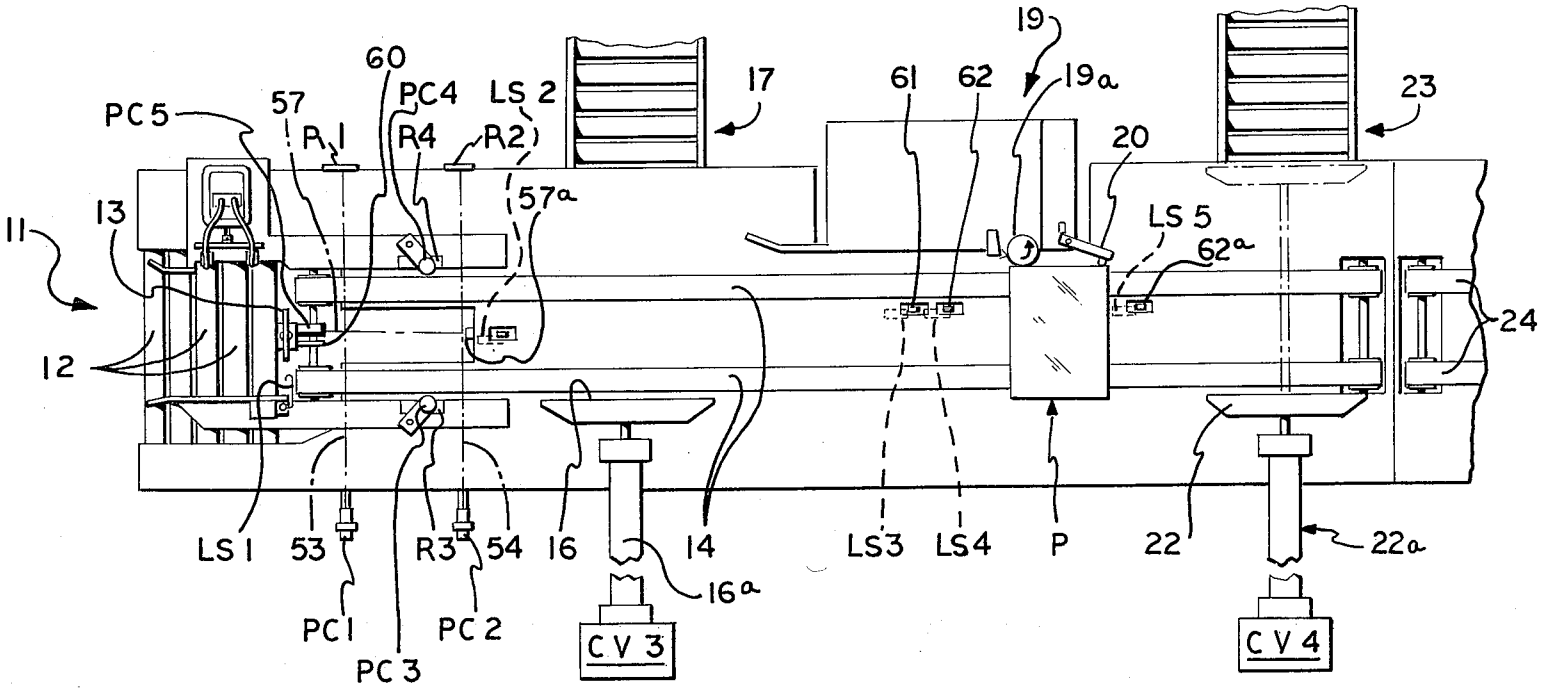
FIG. 1 is a schematic top plan view of the overall apparatus of the present invention, in which apparatus the reams are introduced at the leftmost end and proceed to the right, carried upon the rollers and conveyor belts through the sequence of operations and past the various auxiliary pieces or components which combined comprise the present invention.

Prewrapped and sealed reams of paper are fed by hand or machine to the delivery end 11 of the apparatus of the present invention shown in plan view in FIG. 1. The delivery end 11, at least in part, comprises a plurality of horizontally disposed, parallel, driven rollers 12 which urge the ream against a vertically reciprocable gate 13, controlled to allow the roller-urged reams to individually and sequentially pass onto a pair of horizontally disposed, parallel spaced belts 14. The belts are appropriately driven by suitable motor, preferably a variable speed motor which can be controlled to move the reams at a velocity of 30, 40, and even 50 reams per minute. As the reams are allowed to sequentially pass onto the belts 14, they are immediately inspected by an array of five adjustably and properly positioned photocells identified as PC1, PC2, PC3, PC4 and PC5 and cooperating mirrors. If the ream carried on the conveyor belts 14 is not miswrapped, as determined by the photocell inspection and consequently rejected by the push plate 16 onto the conveyor 17, it is moved past automatic labeler 19 and a label inspector sensor 20. The reams continue past another reject station comprising the pusher plate 22, shown in FIG. 1 in solid outline in the retracted position and in dotted outline in the extended position, adapted to reject a mislabeled ream onto conveyor 23. As indicated, if the ream has not been rejected, it passes to the right onto conveyor 24 for further processing, such as packing, stacking, shipping, etc.

Figure 2:
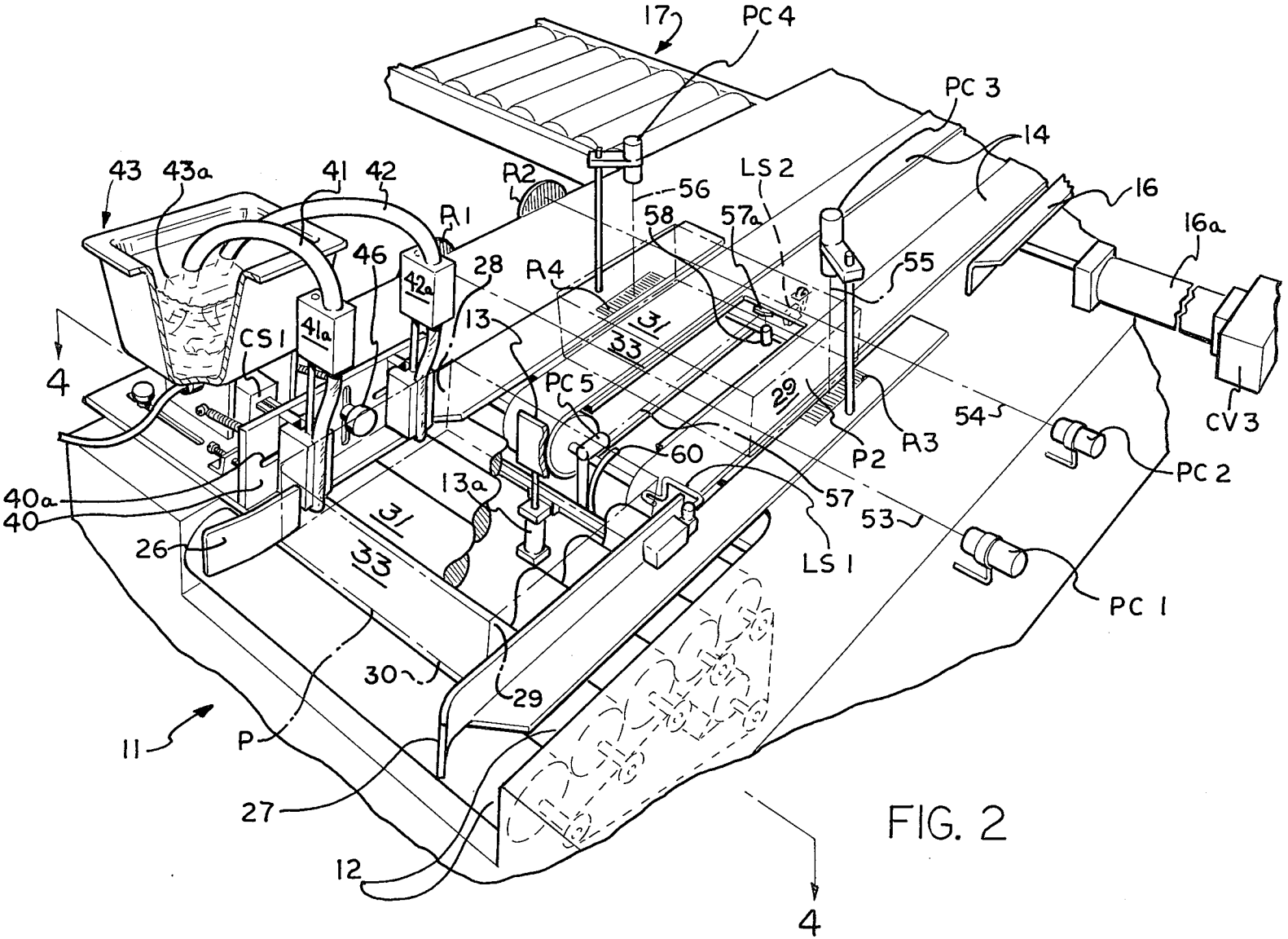
FIG. 2 is a three-quarter perspective view with parts broken away of the leftmost or entry end of the apparatus illustrated in FIG. 1.

Returning now to the fore end 11 of the apparatus of the present invention, the reams are introduced onto the rollers 12 and between a pair of guide shoes 26 and 27 (see FIG. 2). The guide shoes are bowed outwardly at the entry end for easy entry and are otherwise spaced apart in parallel relationship throughout their extent, that is, to the gate 13, a distance corresponding to the width of the ream, measured from one side to the other; both sides bearing the fold ends of the covering wrapper and identified by the reference numerals 28 and 29. The thickness of the ream corresponds to the dimension between the bottom surface 30 and the top surface 31, while the width of the package is measured between the surface 32 which is the leading end of the package and the rear surface 33 which is the trailing end of the package. The bottom surface of the ream is the site of an edge overlap 30*a;* the reference numeral 30*a* identifying the inner hidden edge of the ream wrapper and the reference numeral 30*b* identifying the outer exposed edge of the wrapper facing rearwardly toward the rear surface 33 taken with respect to the movement of the ream to the left as shown in FIG. 5 and to the right as shown in FIGS. 1, 2, 3 and 4.

The rollers 12, as shown in FIG. 2, are driven by a common belt trained over pulleys keyed to each of the roller shafts and said common belt passing about a motor driven pulley. For convenience and simplicity, the array of pulleys for each of the rollers, the motor and the belt are shown in dotted outline. The belts 14 are driven and carried about suitably spaced rollers, driven by a suitable motor, controlled to give the rate of travel as described earlier herein.

The rollers 12 carry the introduced ream between the guide shoes until the forward face 32 of the ream hits the gate 13. Simultaneously, the forward face of the ream trips limit switch LS1, situated near the end extremity of right-hand guide shoe 27. The urgement of the rollers 12, the left-hand guide 26, the right-hand guide 27 and the gate 13 all cooperate, via contact with the corresponding surfaces of the ream, to properly position the ream for marking with spaced strips of a liquid used during label inspection and also, at the appropriate time, to be carried by conveyor belts through the subsequent operations or stations. The actuation of limit switch LS1, providing other safety features of the circuitry are not actuated, sends a signal to a solenoid CS1 which moves plate 40 toward the ream surface 28 and specifically until the pair of dauber members 41 and 42 press against that surface, applying thereto a deposit of liquid carried in reservoir 43 into which the opposite ends of the linear dauber members 41 and 42 are immersed, as shown most specifically in FIG. 2. The linear absorbent daubers extend from a retainer 43*a*, beneath the level of the liquid, up over the edge, through a pair of spaced overheads 41*a* and 42*a*, adjustably carried on vertical rods 41*b* and 42*b* which extend down to dauber holders 41*c* and 42*c*, featuring on the conveyor facing side vertically elongate grooves for holding the daubers in the proper position. The carriers 41*c* and 42*c* are secured to the plate 40 via the adjustable screws 41*d* and 42*d* (FIG. 4), respectively, providing for adjustable movement of the daubers individually towards the ream or away from the ream. The plate 40 is carried on the solenoid arm 45 of solenoid CS1; which arm 45 extends through vertically elongate grooves 40*c* to engage knurled knob 46. The solenoid arm in its movement to the rear, taken with respect to the ream, is assisted by the pair of springs 47, respectively anchored in support plates, as shown. The adjustable screws 41*d* and 42*d* extend through laterally elongate grooves 40*a* and 40*b* (FIG. 2) to engage the control knob 41*d*, providing for lateral flexibility as to the locating of the daubers on the particular sized package. Rearward movement of support plate 40 is limited by a pair of adjustable stops 48, as shown. The daubers are flexible and the capillary movement of the liquid from the reservoir to the daubers 41 and 42 is, in part, assisted by the reciprocable movement of the daubers, dauber holders and plate 40 to and fro via the solenoid and solenoid arm 45; the plate also carrying the dauber headers 41*a* and 42*a* via the rods 41*b* and 42*b*. Contact of the daubers with the surface of the ream applies two vertical strips of the liquid, as shown in FIG. 5 and identified by the reference numeral 50. The location and spacing of the deposits 50 on the wrapped ream is easily controlled by loosening the knobs 46, 41*d* and 42*d* and making the necessary desired adjustments and retightening the knobs. Such adjustment is desirable from time to time, depending upon the sized ream being handled by the apparatus of the present invention and, as well, the sized label to be applied over the spaced depositions (see FIG. 5). It may be here mentioned that the desired application of the label is such as to cover the spaced deposits at each end of the label, thereby avoiding completion of an electric circuit by contact of the sensor elements in the downstream inspection station (see reference numeral 20 in FIG. 1).

A suitable conductive coating is composed of a solution of lithium chloride in the proportion of about a tablespoon of commercial grade lithium chloride dissolved in a gallon of water. A commercial detergent such as "White Rain" is also usable and provides the advantage of being noncorrosive.

The liquid coating or the deposition of liquid in the form of strips as described herein is a convenient arrangement for detecting the presence or absence of a label and the proper centering of the label. In some circumstances, it may be more desirable to replace the elongate daubers by a plurality of individual applicators mounted to deposit a plurality of dots or circles onto the end flap region. The dots or circles are created by small daubers mounted in an appropriate tube or cylinder which is resiliently mounted and connected in suitable fashion to a common reservoir of the liquid of electricity-conducting character such that the location of the dots, the proper location of the label and the preselected adjustment of the sensors will provide for initiation of the proper signal and energization of the reject station downstream from the labeler.

The reciprocating movement of plate 40 to bring the wet daubers into contact with the procession of reams may be accomplished by an air cylinder instead of a solenoid, as disclosed herein.

It is possible within the framework of the present invention to substitute other means and devices, for applying the spaced strips of electrically-conducting liquid or fluid, for the daubing apparatus as disclosed and described hereinabove. One suitable alternative is the employment of a silk screen type of device. In this embodiment, a head adapted to issue an atomized spray of liquid would be situated in a closed container having a contact face containing two vertical slots definitive of the size and strip deposit desired; the container being shiftable toward and away from a surface of the ream to be treated, coupled with valve means for initiating and terminating the creation of the mist or spray, only while the slotted surface of the enclosure was held flushly against the end surface of the ream. Other schemes and arrangements are possible for applying spaced strip deposits upon the desired surface of the ream.

After the ream has been simultaneously contacted by the daubers, applying to the end surfaces 28 the spaced deposits of electrically-conducting liquid, appropriate circuitry, activated in part by contact with limit switch LS1 and a connected relay, causes gate 13 to lower, allowing the ream, as urged by the continuously rotating rollers, to pass onto the more rapidly moving belts 14; which belts, after assuming the weight of the ream, propel the reams rapidly downstream. With the ream in the position P2, five carefully located photocells are issuing beams which may be broken by the ream or, more significantly, by a loose segment of wrapper or an end flap not tightly or flushly abutting the ream, as desired in a properly wrapped and tight package. The five photocells are identified as PC1, PC2, PC3, PC4 and PC5. Photocells PC1 and PC2 are both pivotably mounted as shown. The beams 53 and 54 of PC1 and PC2, respectively, project laterally to the left, across the path of the ream P2, hit reflectors R1 and R2 and the beams are reflected back to the photocells PC1 and PC2, respectively. Beams 53 and 54 scan the front and rear surfaces 32 and 33. Photocells PC3 and PC4 on either side of the conveyor are each mounted on a pivotable arm, carried by a vertical support rod and are aimed to issue their respective beams 55 and 56 vertically downward where they respectively hit reflector R3 and reflector R4, from which the beams are reflected back to the photocells PC3 and PC4, respectively. The beams 55 and 56 are situated by appropriate location of the photocells PC3 and PC4 to pass very close to the surfaces 28 and 29, respectively. The surfaces 28 and 29 contain the end flaps of the ream wrapper. These flaps, as indicated previously, have been folded and adhesively secured flushly in automatic machinery. Should the adhesive fail or should the end flap (see FIG. 5) be defective, a piece or a segment of the end flap may project out from the normal surface of the ream and will break the beam as the ream moves downstream past the beams 55 and 56. Photocell PC5 is positioned midway between the belts 14 to inspect the bottom surface of the ream. It projects its beam 57 between the belts proximate the lower surface 30 of the ream package. The beam hits a reflector or, in fact, mirror **57*a* which reflects the beam downward to the photocell receiver identified by the reference numeral 58. As indicated, the beam 57 emanating from photocell PC5 scans the bottom surface of the ream and its particular function is to determine the presence of a miswrap as evidenced by a flapping seam 30*b*. The beam 57 of photocell PC5 works in conjunction with a stream or jet of air which emanates from a nozzle 60 situated alongside of photocell PC5; the orifice of which nozzle is aimed along the bottom surface of the passing ream. Should the overlapped seam 30*b* in the bottom of the ream be loose, the jet or stream of air will cause the seam 30*b* and its associated portion of the wrap to be deflected downwardly, breaking the beam 57 emanating from photocell PC5 and thus sending an appropriate miswrap signal to the circuitry to be described hereinafter. It may be said here generally that if any of the beams 54, 55, 56 or 57 emanating from photocells PC2, PC3, PC4 or PC5 are broken by end folds or bulges in the wrapping, the circuitry and relays will be energized such that as the ream is carried by the belts 14 abreast the control valve CV3 and its associated cylinder 16*a* and connected pusher plate 16 and the lateral conveyor 17, the pusher bar 16 will move laterally towards the conveyor 17 and pushing the miswrapped ream laterally away, thus rejecting it for reprocessing which would normally be rewrapping. The desired end, of course, is that only properly and tightly wrapped reams are allowed to continue downstream, carried on the belts 14 past the labeler 19 (FIG. 1). The ream, in passing rapidly through the photocell inspection area just described, contacts a limit switch LS2 situated between the belts 14 and shown in FIGS. 1 and 2. The limit switch is part of the circuitry controlling the flow of current actuating the various components of the reject apparatus. The function of the limit switch will be described in more detail in connection with the description of the electrical circuitry illustrated in FIG. 11. It is a significant feature of the present invention that the photocells identified by the reference numerals PC1 and PC2 are spaced apart a distance generally corresponding to the length of the ream taken in the direction of movement. Circuitry is relay controlled, as will be described, such that the actuation of the reject control valve CV3 occurs only when the beam 54 emanating from photocell PC2 is broken simultaneously with breaking of the beam 53 of photocell PC1. Breaking of beam 54, if it does not occur simultaneously with the breaking of the beam 53, will not actuate the reject cylinder controlled by control valve CV3. Similarly, actuation of the reject cylinder and pusher bar 16 through control valve CV3 occurs only when beams 55 (PC3), 56 (PC4) or 57 (PC5) are broken simultaneously with primary beam 53, It should be emphasized that the reams carried on conveyor belts 14 are proceeding at a rate of 30 to 50 reams per minute as controlled by the rapid reciprocation of gate 13 and featuring the interspersed actuation of solenoid CS1 moving the daubers on plate 40** against the end wrap of the ream.

Figure 3:
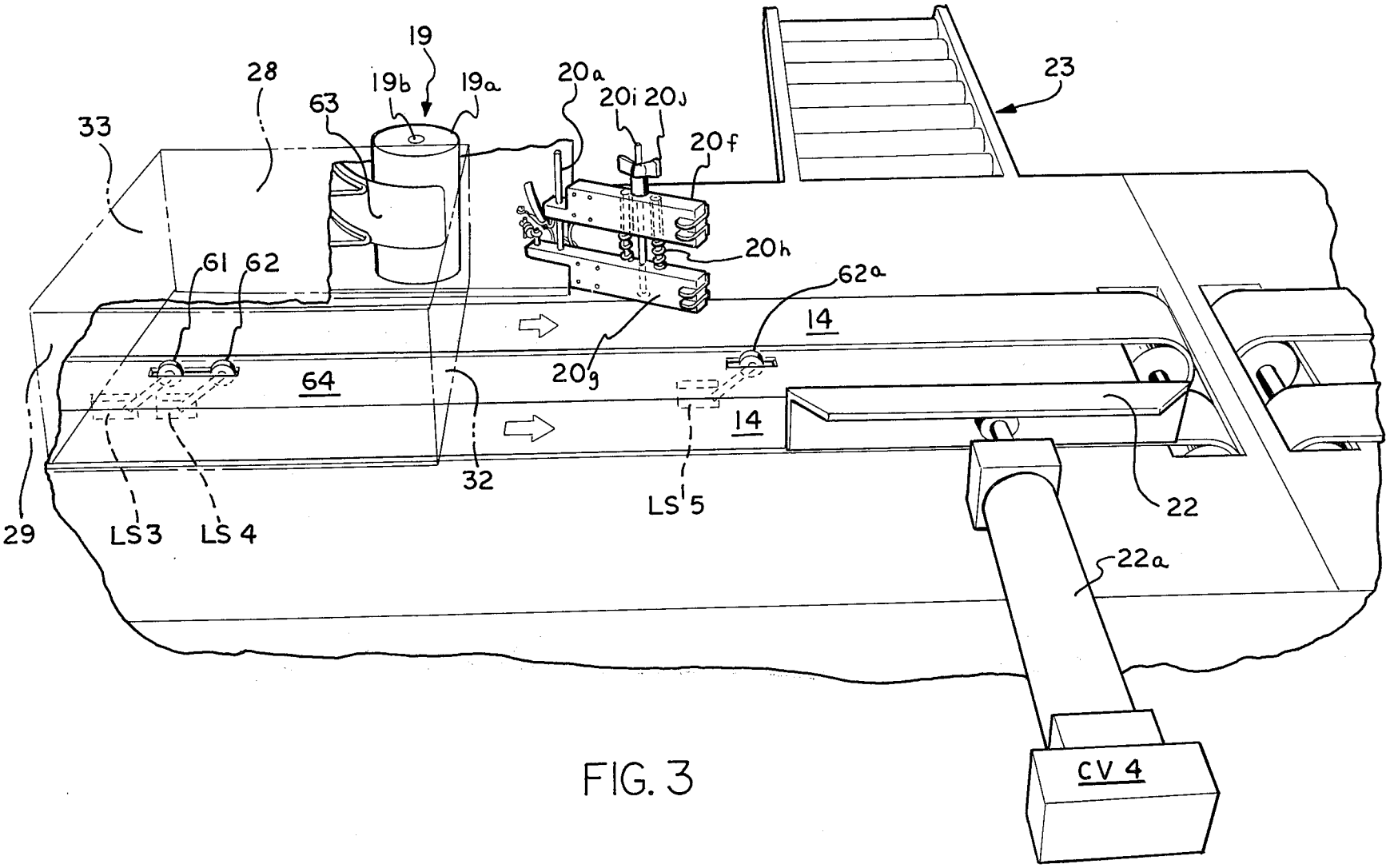
FIG. 3 is a perspective view of the central region of the apparatus illustrated in FIG. 1.

Properly wrapped reams, that is, the reams not rejected by pusher plate 16, move downstream on the belts, past a labeler 19 (FIG. 1 and see also FIG. 3). The labeler and its included mechanism for separating individual labels or tickets from a reservoir supply thereof and delivering them to the delivery roller 19*a* form the subject matter of U.S. Pat. Nos. 3,565,035 and 3,623,451, assigned to the same assignee as the present application. In approaching the labeler, the ream will contact limit switch LS3 and limit switch LS4, specifically by contact with the roller contacts 61 and 62 which deflects the connected arm and thereby actuates the switches in sequence. (The arms and switches are in dotted outline in FIG. 3). These switches actuate the initiation of the labeler and specifically in delivering a label 63 to the roller 19*a* (FIG. 3) which is freely rotatably mounted on shaft 19*b* located in such position as to urge the roller 19*a* against the ream surface and thereby press the label 63 against the end wrap surface 28 of the particular ream passing this station. The limit switch roller members 61 and 62 project slightly upward through a slot in the metal plate 64, across which the belts 14 move. The subject matter of the referred-to U.S. Pat. Nos. 3,565,035 and 3,623,451 is incorporated herein by reference. The labeler can be adjustably located, depending upon the size of the ream packaged and also in conjunction with the location of the limit switches, such that the label is centered onto the end surface of the ream, taken from front to rear in the direction of travel. Similarly, the labeler can be vertically adjusted so that the label is centered on the end wrap surface of the ream midway between the top and bottom surfaces.

A properly centered label 63 is illustrated on ream P in FIG. 5. The size of the label dictates the proper spacing of the vertical strips in such fashion that the label will extend at least across both strips with a small amount of overlap. A properly labeled ream is also illustrated in FIG. 7, which is a top plan view, from which it can be seen that each of the strips of liquid deposition are covered by the label 63. The location of the strips is also determined by the length of the ream. The strips 50 in the illustration of FIG. 7 are thus equidistant from the ends 32 and 33. Reference to FIG. 6, which is like FIG. 7, reveals a label 63 which is miscentered on surface 28 towards the trailing end 33 of the ream and is further away from the leading end 32 such that the label does not completely cover the strip, which is identified in FIG. 6 by reference numeral 50a to distinguish it from the properly covered strip 50 in FIG. 6. With the strip 50*a* at least partially uncovered, it is exposed for contact by the sensor 20 which is pivotably mounted on vertical bar 20*a*, situated just downstream from the glue roller 19*a* (FIG. 3). The sensor is designed to initiate the flow of electricity in reject circuitry if the sensor elements contact the strip 50*a*. The sensor is shown in detail in FIGS. 3 and 10.

Referring to FIG. 10, the sensor is composed of four vertically spaced elements 20*b*, 20*c*, 20*d* and 20*e*; each of which include an offset ear portion adapted to slidingly contact the surface 28 of the ream. As shown in FIG. 3, the elements 20*b*, 20*c*, 20*d* and 20*e* are mounted in a pair of holders 20*f* and 20*g*; the rear portions of which are pivotably mounted, as previously indicated, on the vertical rod 20*a* and which holders are spaced apart by a pair of springs 20*h*; one on either side of an adjusting pin 20*i* which is threaded at one end to engage a wing nut 20*j*. This construction as described allows the holders 20*g* and 20*f* to be adjusted in order that the sensor pair 20*b* and 20*c* and pair 20*d* and 20*e* can be moved closer together or farther apart. The sensors 20*b* and 20*e* and sensors 20*c* and 20*d* are connected by suitable wiring, as shown in FIG. 10, to each other and to a lead wire 20*k*, which connects with the circuitry illustrated in FIG. 11; the details of which circuitry will be explained in more detail in connection with the description of FIG. 11. It may be here stated that current flow for effecting rejection of a mislabeled ream will be actuated if there is current flow between either of the pairs of elements 20*b* through 20*e*. Thus, if current flows between elements 20*b* and 20*c*, a circuit will be completed, allowing current to flow and actuate control valve CV4 which causes reciprocating movement of reject cylinder 22*a* and plate 22. Similarly, if current flows between elements 20*d* and 20*e*, the current flow will energize the reject station downstream. Current flow or completion of the circuit of the elements as just described can be accomplished if either of the pairs of elements simultaneously contact either of the strips 50 as the sensor 20 slides across the moving end of the ream.

Referring now again to FIG. 7, it can be seen that none of the contact elements 20*b*, 20*c*, 20*d* or 20*e* will contact either one of the strips 50 as the ream moves in the direction of the arrow on belt 14 because the label covers the strips in the center (see FIG. 5 also). On the other hand, looking at FIG. 6, with the label miscentered to the rear, taken with respect to the direction of movement, the sensor element pairs 20*b*-20*c* and 20*d*-20*e* will contact the electrically-conducting liquid strip 50*a*, completing the circuit and causing current flow which will, in a manner to be described in more detail, energize the control valve CV4, its associate reject cylinder 22*a* and the connected pusher plate 22, causing the mislabeled ream to be pushed laterally onto reject conveyor 23. As indicated, with the ream label properly centered as in FIG. 7, the sensor pairs do not contact the strips, whereby no circuit is completed and no current flows, whereby the ream proceeds safely past the reject station plate 22 onto the takeoff conveyor belts 24.

The construction of the sensor is also capable of detecting a label which is miscentered from the top to the bottom of the package. Looking first at FIG. 8, it can be seen that the spacing of the sensor pair 20*b*-20*c* and sensor pair 20*d*-20*e* has been controlled by appropriate setting of wing nut 20*j*, moving the holders 20*g* and 20*f* and, of course, consequently the sensor elements to conform to the height of the label 63. With the sensor elements properly vertically adjusted and the label properly centered between the top and the bottom of the ream, sensor element 20*b* contacts the vertical strip 50 but sensor element 20*c* does not, because it is intercepted by the label. Similarly, in the bottom pair, sensor element 20*e* contacts the strip 50 but sensor element 20*d* does not. With the sensor contacts as just described, no circuit is completed and no current flows so that the reject station is not actuated. In contrast, in FIG. 9, the label is miscentered towards the top of the ream and while the top pair of sensor elements 20*b* and 20*c* do not contact the strip, the lower pair of sensor elements 20*d* and 20*e* are in contact with the strip 50, whereby a circuit is completed from 20*d* to the strip, to the element 20*e*, thereby actuating, through appropriate circuitry illustrated in FIG. 11, the reject control valve CV4, cylinder 22*a* and pusher plate 22, causing the mislabeled ream to be pushed laterally onto takeoff conveyor 23. A ream bearing a properly centered label vertically and horizontally will cause no contact of elements in a given sensor pair with strips and no current flow in the sensor pairs, whereby the reject circuitry remains inactive. Consequently, the properly labeled ream will pass onto the takeoff conveyor 24. It can be seen that the sensor member 20, composed as it is of two pairs of elements, is uniquely designed in conjunction with the spaced strips of electrically-conducting coating to simultaneously detect centering of the label vertically and horizontally. The spacing of the sensors 20*b* to 20*c* provides some flexibility and tolerance for label centering. Flexibility and tolerance, as to miscentering, is also provided by proper lateral spacing of the vertical strips which, of course, depends upon the lateral spacing of the daubers 41 and 42. Lateral spacing of the daubers which controls the spacing of the deposit strips is, of course, easily accomplished by finger adjustment of the knurled knobs 41*d* and 42*d* (FIG. 4) and finger movement of the dauber carriers 41*c* and 42*c* in the lateral slots 40*a* and 40*b* in plate 40.

From the description thus far, it can be seen that reams, that is, wrapped packages of paper, are conveyed in a linear path in the apparatus of the present invention as illustrated in FIG. 1. The reams are sequentially stopped adjacent the dauber apparatus where the spaced deposits are applied to the stationary ream. In sequence then, rapidly and automatically, the reams are picked up by the spaced conveyor belts and moved linearly through the sequence of stations. Thus, reams are sequentially, via reciprocation of gate 13, passed onto rapidly moving twin conveyors 14, past an array of photocells situated and connected with appropriate circuitry to a reject station, e.g., pusher bar 16, controlled by valve CV3. The photocells provide inspection of properly and tightly wrapped reams. If the circuitry controlling the photocells is not activated, the reams pass unrejected through a labeler station 19 where a label is applied and thence past label inspector sensor member 20, electrically connected to a second reject station, e.g., pusher bar 22, controlled by valve CV4, actuated to reject mislabeled reams onto takeoff reject conveyor 23. Properly labeled reams pass linearly onto takeoff station 24.

Reference should now be had to FIG. 11 which contains a circuit diagram including the circuitry, limit switches, relays, solenoids and valves as cause or control the sequence of operations just described. In FIG. 11, reference numerals 61 and 62 identify line current, across which are the various lines of current flow, with current flow being interrupted by photocell circuitry, limit switches or timer relays; all of these being interconnected to control gate valve 13 via cylinder 13a and control valve CV1, the daubers 41 and 42 controlled by solenoid CS1, the inspection air emanating from nozzle 60 controlled by control valve CV2 and the reject valves CV3 and CV4 controlling the pusher bars 16 and 22 via cylinders 16a and 22a, respectively.

The circuitry as controlling the sequence of operations is best described by starting at the upper part of FIG. 11 and proceeding downwardly. As previously indicated, a ream entering the apparatus of the present invention is moved by rollers 12 to a stop position between the guide shoes 26 and 27 resting against a gate 13 controlled by cylinder 13*a*, in turn governed by control valve CV1. Simultaneously, the ream will contact limit switch LS1, closing it and causing current to flow across the contact points 63 to a normally open switch 64 controlled by photocell PC1. If a ream is in the path of beam 53 of photocell PC1, switch 64 will stay in the open position so that the current does not flow across the switch. If the beam 53 of photocell PC1 is unbroken, switch 64 is closed and allows the current passing limit switch LS1 to flow across switch 64, through line 65, to control relay timer CR1(T) which controls the open/close position of the four contact points 66, 67, 68 and 69 which are normally open. The relay timer (CR1(T) also reverses in timed delay the normally closed contact 70 and the normally open contact 71. Current reaching relay timer CR1(T) via line 65 and switch 64 closes contact points 66, 67, 68 and 69. With contact point 69 closed, current in line 72, extending from line current 61 through closed switch SS7, passes through contact 69 and normally closed contact 70 to control solenoid CS1 and to line current 62. Switch SS7 located at the lower left of FIG. 11 is manually controlled and is normally left in the closed position unless it is desired to stop the daubing operation. The actuation of control solenoid CS1 causes the plate 40 carrying daubers 41 and 42 to move out to contact the surface 28 of the ream, applying the strips of the electrical-conducting liquid. Almost immediately, the control relay timer CR1(T), adjusted to a short delay, switches the position of contacts 70 and 71. This opens contact 70; thus deenergizing dauber control solenoid CS1, whereby springs 47 return plate 40 and daubers 41 and 42 to the retracted position. Simultaneously, contact 71 closes. With contact 66 closed, current flows from line 65 through contact 66, contact 71, thence across manually closed selector switch SS1 to valve CV1, which lowers gate 13 (FIGS. 1 and 2), allowing the ream to pass onto the belts as urged by rollers 12. Almost immediately, carried by belts 14, the ream breaks the beam 53 emanating from photocell PC1 to reflector R1 and back, closing normally open contact 64*a* and opening contact 64. The opening of contact 64 cuts the current to line 65 and control relay timer CR1(T), returning all controlled switches to the original positions. The closing of switch 64*a* connects current in line 61, through line 73, to control valve CV2, initiating flow of a stream of air out the nozzle 60 and across the bottom of the ream. The air stream hitting the overlapped wrapper edge 30*b* (FIG. 2) will urge a loose edge, indicating a poor wrap, outwardly onto the path of beam 57 of photocell PC5, initiating circuitry energization leading to reject of the ream as described later herein. Current flow in line 73 also passes via line 74 to contact switch 76 which is normally open. Now it will be appreciated from FIG. 2 that the package passes the array of photocells PC2, PC3, PC4 and PC5. If none of the beams emanating from these photocells are interrupted by a loose end wrap or an air bulge in the ends, sides or bottom of the ream, switch 76 stays open and the package will proceed past the reject conveyor 17. The control of switches 64 and 64*a* via photocell PC1 is provided by master inspection control unit PEC1. Commercially, the control unit is available from General Electric as Part No. 3S7505PG520A1 in conjunction with General Electric Relay 3S7505KH501A1. The sequence just described will be repeated when the next ream hits limit switch LS1; in which case, with the beam 53 of photocell PC1 unbroken, the current will flow through switch 64 to line 65 to energize control relay timer CR1(T).

Rejection of a miswrapped ream is initiated by inspecting the ream perimetric surfaces by carefully and properly positioned photocells PC1, PC2, PC3, PC4 or PC5 and reflectors. If only beam 53 of photocell PC1 is broken, no rejection circuitry is actuated. If any of the other beams 54, 55, 56 or 57 are broken by an improper wrap while beam 53 is also broken, the switch 76, which is normally open, will close. Since beam 53 is still broken, current is flowing across closed switch 64a and through lines 73, 74 and 75 to switch 76 which, being closed, allows the current to flow to line 77 and to control relay CR2. The slightest breaking of the beams 54, 55, 56 or 57 will allow an impulse current to reach control relay CR2, energizing it. Actuation of control relay CR2, even for an instant, closes normally open contacts 78 (and 79), allowing current flow from line 61 to proceed through line 85 and normally closed contact 83 controlled by control relay CR3 to line 80 and across 78 to control relay CR2. This current flow holds control relay CR2 actuated, even though current in line 77 may cease due to opening of switch 76 caused by lack of broken photocell beams, until the ream contacts the toggle of limit switch LS2, shown in the middle of FIG. 11 as a double pole switch with the top set open and the bottom set closed. When the ream hits limit switch LS2, it closes the top set and opens the bottom set. With the top set closed, current passes from line 61, through line 79*a*, through closed contact points 79 and through the top set of poles of limit switch LS2, furnishing the just-described current to control relay CR3. At the same time, the lower set of points of limit switch LS2 are open. When control relay CR3 is actuated, the contacts 81, 82, 83 and 84 reverse so that contact 83 opens and contacts 81, 82 and 84 close. Contact 83, now open, cuts off current to control relay CR2, with the result that contacts 78 and 79 open, cutting current from contact 79 to limit switch LS2 and control relay CR3. Contact 82, being closed, however, allows current to flow from line 61, to line 85, through the contact points 82, to line 82*a* and through normally closed contacts 88 of timer CR3(T) to line 86, holding energization of control relay CR3. A preset time interval is set in timer CR3(T). The ream leaving limit switch LS2 allows the lower set of points to return to the closed position and the upper set to open. The closing of the lower set of points of limit switch LS2 allows current in line 61 to flow in line 85, across lower contacts of limit switch LS2, through closed contacts 81 and to the reject valve CV3 and simultaneously to the reject signal horn 93 (assuming that switch SS3 is closed, which it normally is). Actuation of reject valve CV3 energizes cylinder and pusher bar 16, causing it to swiftly push the ream from the main conveyor to take-off conveyor 17. After the preset time interval set into the control relay timer CR3(T) has passed, the position of contacts 88 and 89 reverses, with 88 opening, cutting off the flow of current to control relay CR3, which in turn reverses the position of contacts 81, 82, 83 and 84 to as shown, e.g., contact 83 closed and contacts 81, 82 and 84 open. With contact 81 open, current to reject control valve CV3 ceases and the pusher plate 16 returns to its retracted position, awaiting the next actuation of control valve CV3 via the sequence initiated by the impulse initially created by the breaking of the beams emanating from any of photocells PC2, PC3, PC4 or PC5 and including consequent energization of control relays CR2 and CR3 and contact of limit switch LS2. Photocells employed are General Electric coaxial scanner cells identified as Part No. 3S7505SS10A6.

Referring again to FIG. 11, reference numeral 20 identifies the sensor disclosed in FIGS. 1, 3 and 10, employed to detect the presence of a miscentered label on a ream carried contactingly past the sensor 20, following application of the label by the labeler 19. The sensor 20 would, of course, also detect a ream which contained no label by contact of the sensor elements with the strips of conducting liquid. As has been described in connection with the hereinabove description of FIGS. 5–9, the sensor is designed to initiate the flow of current across either of two contact pairs consisting of pair 20*b*-20*c* and pair 20*d*-20*e*. Thus, if either of the elements of a given pair simultaneously contact the strips of electrically-conducting coating not covered by a label or only partially covered, then an electrical current impulse will be set up in inspection control unit PEC3, which is a control unit marketed by Dolan Jenner Company as No. 571 and used in conjunction with a Potter and Brumfield Relay No. KRP-11-DG. The control unit PEC3, when energized, closes contacts 94, allowing current to proceed to line 95, to control relay CR4 which is connected via line 96 to ground line 62. The impulse actuation of control relay CR4 will close contact points 97 and 98, enabling continued energization of control relay CR4, even though the initiating current in line 95 ceases when contacts 94 open as controlled by PEC3, responsive to the lack of contact of the sensors with the electrically-conducting strip on the package. The current for sustaining energization of control relay CR4 proceeds from line 61 via line 99 to normally closed contacts 102, thence via line 104 and across closed contacts 97 caused by the initial actuation of CR4; the circuit being completed across CR4 via line 96 to ground line current 62. At the same time, the closure of contact 98 allows current from line 61 to proceed via lines 99 and 105, across contact 98 and via line 106 to line 107 which connects to the upper normally open set of contacts of limit switch LS5. It can be seen that contacts 100, 101 and 103 controlled by control relay CR5 are open, while contact 102 is normally closed, as previously described. The ream, after passing the sensor 20, immediately contacts roller 62*a*, actuating limit switch LS5 situated between the belts 14 (FIGS. 1 and 3), closing the normally open upper contacts (FIG. 11) and opening the normally closed lower contacts. With the upper set closed, current in line 107 proceeds across the contacts and via line 108 to actuate control relay CR5 which is connected as shown to line current 62. The actuation of control relay CR5 reverses the connections of the contacts 100-103, opening contact 102, terminating current flow through line 104 to control relay CR4. Also, contacts 100, 101 and 103 close. With the deactuation of CR4, contacts 97 and 98 automatically return to their normally open position. Simultaneously, with the actuation of control relay CR5, the control relay timer CR5(T) is actuated by current across now closed contact 101 and via line 109, proceeding to the normally closed contact 110 and thence to line 108, as shown. When the ream passes, terminating contact with limit switch LS5, the upper contacts of LS5 return to their open position and the lower contacts are closed, whereby current in line 99 crosses these closed contacts of LS5 to line 111, across the closed contacts 100 to line 112 to line 113, actuating control valve CV4 which, as shown, is directly connected to line current 62. Actuation of the control valve CV4 (see FIGS. 1 and 3) causes plunger 22*a* to push the pusher bar 22 across the main conveyor, thereby rejecting the ream to takeoff conveyor 23. Simultaneously, current in line 112 will pass via line 113 and normally closed selector switch SS8 to actuate the bell 114 which, as shown, is connected to line current 62. The preset time interval set into the control relay timer CR5(T) will, upon the passage of the time set, open contacts 110, terminating the flow of current to control relay CR5 via lines 108, 109 and 99 and across contacts 101. Simultaneously, with control relay CR5 deenergized, the contacts 100, 101, 102 and 103 will reverse to their original position as shown in FIG. 11; thusly, contacts 102 close and 100, 101 and 103 open. This will terminate current flow to control valve CV4 via line 112 (since the contacts 100 are now open), allowing the cylinder 22*a* to return the pusher bar to its position as shown in solid outline in FIG. 1. At this juncture, all the switches, contacts and relays have been returned to their position as shown in FIG. 11, principally with contacts 94 controlled by sensor 20 open. With this switch open and all other switches and contacts in the position as shown, there is no current flow nor actuation of the control relays, timers or reject valve, control valve CV4.

It will be understood, of course, that the preponderant majority of reams passing the sensor 20 will not complete the circuit across the sensor pairs 20*b*-20*c* or 20*d*-20*e*; in which case, the closing or actuation of limit switch LS5 will have no effect on the current flow in the circuitry illustrated and particularly no actuation of the reject control valve CV4, whereby the package ream will proceed as conveyed by the belts 14 to the takeoff conveyor 24 downstream, as shown in FIG. 1 and also FIG. 3.

In the interest of making a complete disclosure of the operation of the preferred embodiment of the present invention, reference is made to FIG. 12 which is an electric circuit diagram of the circuitry controlling the elements of the labeler 19. As indicated, the labeler is disclosed in detail in U.S. Pat. Nos. 3,565,035 and 3,623,451; said disclosure being incorporated herein; said patents having issued on Feb. 23, 1971 and Nov. 30, 1971, respectively. In this connection, a single limit switch as shown in the drawings and description of either of the U.S. patents would operate satisfactorily in the present apparatus. However, as shown in FIG. 1, the reams proceeding on belts 14 do contact limit switch LS3 and limit switch LS4 which are identified in FIG. 12 just before the labeler 19 and serve a function as will now be described and which generally reflects a minor change of the circuitry illustrated in the referred-to patents; the principal purpose being to define the sequence of actuation of a particular air valve and a guide shoe. The air valve directs a stream of air upon a reservoir stack of labels, assisting separation of one label from the remainder. The guide shoe then urges the separated label against transfer roller, to an assist roller and to a glue roller from which the label passes to the roller 19*a* which presses the label against the surface 28 of the passing ream. The employment of limit switches LS3 and LS4 contacted in immediate sequence by the ream as it proceeds safely past the reject station controlled by reject control valve CV3 and just prior to contact with the label application roller 19 is as follows. The principal labeler switch 120, when closed, allows current to pass via line 121 and to line current 62, across the labeler drive motor 122. At the same time, the current proceeds to the open contact of limit switch LS3. When the ream closes limit switch LS3, current passes via line 123 to actuate the timer relay 124 which is connected to line current 62 and controls the position of contacts 125 and 126. Specifically, the timer is set to open normally closed contacts 126 at a preset time interval. Since contact 126 is normally closed, the current can flow via line 124*a*, via line 123, across closed contact 126 to line 127 and thence to air valve 128. The automatic timer reverses or opens contact 126, terminating the flow of electricity to the air valve. The ream in contacting limit switch LS4 causes current to flow via line 129 to the guide shoe solenoid 130. The solenoid 130 actuates reciprocal movement of the guide shoe in a manner described in the patent. Limit switch LS4 then opens as the ream passes downstream and current flow to the solenoid is terminated; the guide shoe returning to a neutral inoperative position, awaiting the next sequence initiated by the next ream contact with limit switches LS3 and LS4 in sequence. The remainder of the circuitry forms no significant part of the present invention. Suffice it to say that the switch 131 controls conveyor motor 132, while switch 133 controls an auxiliary electrical resistance element 134 employed in the labeler, while resistance heater 138 controls the temperature of the glue or adhesive in the glue box which is a part of the labeler apparatus; the temperature through flow of current in line 139 being controlled by the switch 140 which opens as the temperature rises too high, terminating the flow of current in heater 138 and also heater 141; which heater is also employed in temperature control of the adhesive in the labeling apparatus. The circuitry as described with respect to the air valve 128 and the guide shoe solenoid 130 is such that the timer relay controls the time interval of air valve actuation and provides a greater flexibility in the proper sequential actuation of the elements as described.

The detailed disclosure of the present invention hereinabove will suggest any number of obvious alternatives and substitutions to those skilled in the art. Accordingly, it is intended that all such obvious equivalents and substitutes shall be considered within the scope of the present invention unless excluded by the language of the appended claims.

We claim:

1. A combination of electrically actuated and electrically connected elements adapted to monitor a sequence of wrapped articles moving in a path, certain of said elements being located in said path for actuation by said moving articles and serving to effect rejection of certain miswrapped articles from said path, said combination including a first limit switch (LS1) positioned in said path for actuation by an article, a first photocell and light source combination (PC1) located to project an interruptable first beam across said path, a relay (CR1), a plurality of switches (66 and 69) controlled by said relay, a first control valve (CV1) regulating a movable gate intermittently intercepting said path and which controls movement of articles, a second control valve (CV2) regulating intermittent flow of air against said wrapped articles, a switch (64) which closes upon actuation of said first photocell (PC1) by a light source to actuate control valve (CV1) to open said gate valve, a switch (64a) which closes when light directed at photocell (PC1) is interrupted by an article to actuate valve (CV2), at least one additional auxiliary photocell and cooperating light source combination (PC2) located to project an interruptable second beam proximate the perimeter of an article to detect miswrapped articles, a control relay (CR2), a normally open switch (76) controlled by said auxiliary photocell, a second limit switch (LS2) positioned in said path for actuation by a moving article, a third control relay (CR3), a plurality of switches whose open or closed position is controlled by control relay (CR3), a reject valve (CV3) controlling a reciprocable push rod located to move an article out of said path and a plurality of wire conductor means connecting the above-recited elements to each other and to a source of electrical current in the manner illustrated in FIG. 11.

2. The combination as claimed in claim 1 which includes a normally open sensor switch (20) which is closed by contact with a conductor of electricity, a normally open auxiliary switch (94) controlled by said sensing switch, a control relay (CR4), a pair of switches controlled by said control relay, a limit switch (LS5), a control relay (CR5) a plurality of switches controlled by said control relay (CR5), a reject valve (CV4) and conductor means connecting the above-recited elements to each other and to a source of electrical current in the manner illustrated in FIG. 11.

3. In a conveyor system for transporting a plurality of articles such as boxes, reams of paper and the like in single file sequence along a defined path; the improvement which comprises a combination of electrically actuated and electrically connected elements designed to determine certain dimensions of said article and to reject articles of preselected dimension, said combination of elements including:

a first light source and photoelectric cell pair located to project an interruptable first beam across said path, a second light source and photoelectric cell pair generally located to project an interruptable second beam proximate said defined path but in such position that simultaneous interruption of both beams can result only if said article exceeds a certain preselected dimension, a relay means (CR2) initially actuated by simultaneous interruption of said first and second beams, said relay (CR2) including normally open contacts (78 and 79) which close when said relay means is actuated, a double pole limit switch (LS2) in said defined path for contact by a box or ream and the like, said limit switch including a pair of normally open and a pair of normally closed contacts which are respectively closed and opened when contacted by a moving box and which return to normal open and closed position when box contact ends, a relay means (CR3) including a set of normally closed contacts (83), a set of normally open contacts (81) and a set of normally open contacts (82), conductor means connecting line current through contact (83) to contact (78) to relay (CR2), thereby holding said relay (CR2) contacts (78 and 79) closed regardless of actuation by said beam interruption, conductor means connecting line current through contact (79) through normally open contacts of limit switch (LS2) to relay means (CR3), thereby actuating relay (CR3) when limit switch (LS2) is contacted, conductor means connecting line current through contact (82), closed upon actuation of relay (CR3), to relay (CR3) to hold relay (CR3) actuated regardless of position of contact (79) or position of limit switch (LS2), an electrically actuated reject valve means (CV3), and conductor means connecting said reject valve means (CV3) through contact (81) and through normally closed contacts of limit switch (LS2), whereby termination of box contact closing said limit switch contacts will actuate said reject valve.

4. Conveyor system as claimed in claim 3 which includes a timer relay ( CR3 (T) ) including a pair of normally closed contacts which open following a predetermined increment of time set into said timer and electrical connecting means communicating with said second relay means (CR3) and which, following the predetermined time increment, deactuates the second relay means and deactuates said reject valve.

5. Conveyor system as claimed in claim 3, wherein said first and second pairs project horizontal beams.

6. Conveyor system as claimed in claim 5 which includes a third pair and a fourth pair projecting vertical beams on either side of said article or path.

7. Conveyor system as claimed in claim 6 which includes a fifth pair situated to scan the bottom surface of said article.

8. In a conveyor system for transporting a plurality of articles such as boxes, reams of paper and the like in single file sequence along a defined path to an accumulation and cartoning station, said articles, such as reams, being desirably of uniform size for such accumulation and cartoning; the improvement which comprises:

1 means for inspecting articles to detect perimetric irregularities, said means comprising a plurality of spaced coaxial photoelectric cell and reflector pair situated and positioned to project and receive a plurality of spaced beam signals defining, in aggregate and spaced relationship, a perimeter just larger than the normal perimeter of said articles whereby a perimetric irregularity will cause an interruption of two of said spaced beams.

2 switch means controlled by said photocell, 3 a reject valve energized by flow of electricity, 4 a push rod actuated by said valve situated to reject, by pushing out of said defined path, an article which simultaneously interrupts said spaced beams of said photoelectric cell reflector array, 5 a pair of relays in circuit relationship with said photoelectric cell means and said switch means and 6 a limit switch located in said defined path for contact actuation by an article moving in said path, said limit switch being in circuit relationship with said relays and serving to delay actuation of said reject valve until said limit switch is contact actuated by said article, all of said items (1), (2), (3), (5) and (6) being connected by conductor means to each other and a source of electricity.

* * * * *